C6306 OR 4,547,282

United States Patent [19]

Schindler

[11] Patent Number: 4,547,282

[45] Date of Patent: Oct. 15, 1985

[54] COAL LIQUEFACTION AND HYDROGENATION

[75] Inventor: Harvey D. Schindler, Fair Lawn, N.J.

[73] Assignee: Lummus Crest, Inc., Bloomfield, N.J.

[21] Appl. No.: 605,690

[22] Filed: Apr. 30, 1984

[51] Int. Cl.[4] ..... C10G 1/00

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,143,489 | 8/1964 | Gorin | 208/10 |
| 4,189,371 | 2/1980 | Maa et al. | 208/8 LE |
| 4,192,653 | 3/1980 | Gianetti et al. | 208/10 |
| 4,303,494 | 12/1981 | Whitehurst et al. | 208/10 |
| 4,303,498 | 12/1981 | Chikata et al. | 208/8 LE |
| 4,330,388 | 5/1982 | Anderson et al. | 208/10 |
| 4,338,182 | 7/1982 | Vernon et al. | 208/8 LE |
| 4,371,727 | 2/1983 | Gavin | 208/10 |
| 4,372,838 | 2/1938 | Kulik et al. | 208/8 LE |
| 4,374,015 | 2/1983 | Brulé | 208/10 |
| 4,411,767 | 10/1983 | Garg | 208/10 |

*Primary Examiner*—D. E. Gantz
*Assistant Examiner*—Lance Johnson
*Attorney, Agent, or Firm*—Elliot M. Olstein

[57] ABSTRACT

The coal liquefaction process disclosed uses three stages. The first stage is a liquefaction. The second and third stages are hydrogenation stages at different temperatures and in parallel or in series. One stage is within 650°-795° F. and optimizes solvent production. The other stage is within 800°-840° F. and optimizes the $C_5$-850° F. product.

21 Claims, 2 Drawing Figures

COAL LIQUEFACTION AND HYDROGENATION

Figure 1:
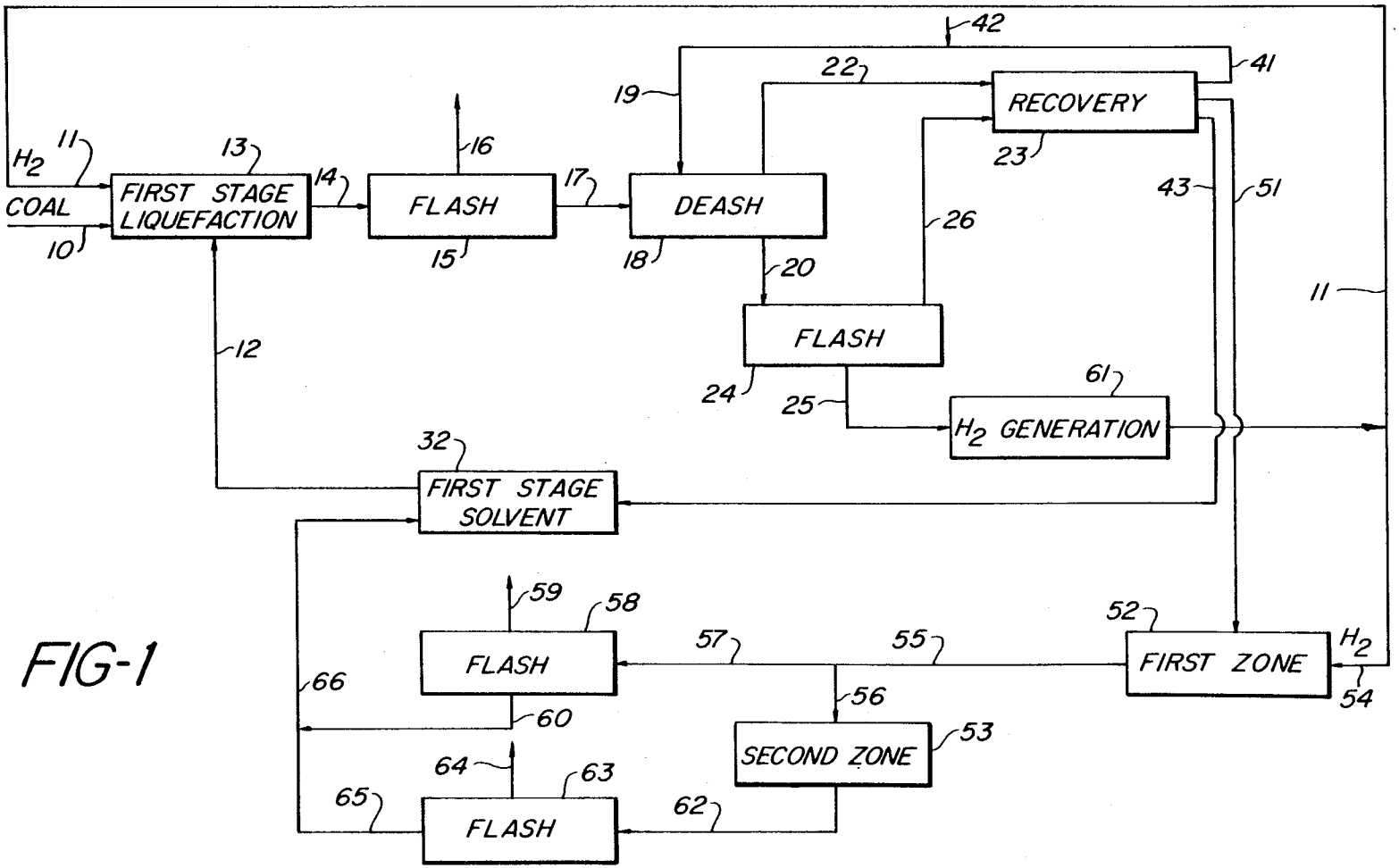

The Government has rights in this invention pursuant to Contract No. DE-AC22-79ETI 4804 awarded by the U.S. Department of Energy.

The present invention relates to liquefaction of coal, and more particularly to improvements in a two-stage process for coal liquefaction.

Coal has been liquefied in a single liquefaction stage comprised of a preheater coil where coal liquefaction is essentially completed, followed by a dissolver, where both liquefaction solvent and coal derived liquids are further hydrogenated.

Recently, there has been proposed a so-called two-stage liquefaction process wherein the first reaction stage is a short contact time thermal liquefaction, followed by recovery of essentially ash free liquid, which is upgraded by hydrogenation in a second liquefaction stage.

The present invention is directed to an improvement in such a two-stage liquefaction process.

In copending application Ser. No. 605,764 filed on Apr. 30, 1984, there has been described a procedure for providing an improved two stage liquefaction process wherein the second stage is operated at controlled conditions, namely an overall conversion of 850° F.+ material of least 30% and no greater than 60% and temperatures of at least 650° F. and no greater than 795° F.

Although such conditions favor the production of components for producing an improved liquefaction solvent, it is desired to reduce hydrogen consumption in the second stage. In addition, the control of conditions to favor production of components suitable for formulating first stage liquefaction solvent affects the properties of the final product.

In accordance with the present process, the second stage is designed and operated so as to provide first and second reaction zones. The first reaction, zone which may be comprised of one, two or more reactors, is operated at a temperature of at least 650° F. and no greater than 795° F., and the second zone, which may be comprised of one, two or more reactors, is operated at a temperature of at least 800° F. and generally no greater than 840° F.

In this manner, there can be recovered from the first zone material having a high ratio of hydrogen to carbon which is useful in formulating liquefaction solvent for the first stage, and there can be produced in the second zone, as net product, $C_5$ to 850° F. material, having desired product quality; in particular, a lower ratio of hydrogen to carbon. In this manner, product quality or conversion may be altered in the second zone without affecting the quality of the liquefaction solvent formulated from the components produced in the first zone of the second stage. In addition, it is possible to reduce overall hydrogen consumption in the second stage and increase the overall reaction rate for the second stage.

The first and second zones of the second stage may be operated in series, in which case a portion of the effluent of the first zone is employed in formulating the liquefaction solvent, and the other portion of the effluent from the first zone of the second stage is used as feed to the second zone of the second stage.

Alternatively, the first and second zones of the second stage may be operated in parallel. In such an embodiment, a portion of the first stage effluent which is used as feed to the second stage, is hydrogenated in the first zone to produce materials for use in formulating the first stage liquefaction solvent, and the other portion is hydrogenated in the second zone of the second stage to produce net product ($C_5$ to 850° F. material) of the desired quality.

The 850° F.+ material recovered from the second zone of the second stage may also be employed in formulating the first stage liquefaction solvent.

In accordance with a preferred embodiment, all of the 850° F.+ material from the second stage is used in producing first stage solvent.

In general, the overall conversion, based on 850° F. material, for the second stage (first and second zones) is from 30% to 60%. In general, the conversion in the first zone of the second stage (for producing liquefaction solvent) is from 5% to 25%, and most generally from 10% to 20%.

Applicant has found that by controlling temperature (in the first zone of the second stage), the material produced in such zone contains both hydrogenated material which boils within the range from 500° F. to 850° F., and 850° F.+ material, and that such components have a hydrogen to carbon ratio which makes those materials particularly suitable for formulating a liquefaction solvent for the first stage.

The 850° F.+ material recovered from the second stage for use in formulating first stage solvent (whether from the first or second zone) is the full range of material which boils above the nominal boiling temperature of 850° F. Such material is derived from the coal and contains hydrogenated components which improve the quality of the first stage liquefaction solvent.

Similarly, the material boiling within the range of 500° F. to 850° F. recovered from the first zone of the second stage is derived from the coal, and contains hydrogenated components which improve the quality of the first stage liquefaction solvent.

Accordingly, the conditions in the first zone of the second stage of a two-stage process for liquefying coal are controlled in a manner such that there can be recovered from the second stage sufficient hydrogenated material boiling within the range from 500° F. to 850° F. as well as 850° F.+ material for use in formulating liquefaction solvent for the first stage.

By employing the hereinabove described conditions in the first zone of the second stage, it is possible to provide a liquefaction solvent of improved quality in that a major portion thereof is formulated from hydrogenated materials recovered from the second stage; namely materials which boil above 500° F. (in some cases the materials recovered from the second stage and used in formulating the first stage solvent are the materials which boil above 650° F. in that depending on the pressure employed in the first stage liquefaction, it may be necessary to remove 500° to 650° F. components in that at low pressures the 500° to 650° F. components may flash during the first stage.

In most cases, at least 60% and preferably at least 75% of the liquefaction solvent is formed from the materials recovered from the second stage which boil above 500° F., with the remainder of the liquefaction solvent, if any, being formed from materials recovered from the first stage liquefaction. The material derived from the first stage liquefaction which is used in formulating the first stage solvent is generally 850° F.− material which has an initial boiling point of at least 500° F. (in some cases the initial boiling point may be at least 650° F., as hereinabove noted). Thus, the first stage liquefaction solvent may be comprised of from 60% to 100% of material from the second stage and from 0% to 40% of 850° F.− material from the first stage. In most cases, the liquefaction solvent includes at least 5% (preferably at least 10%) and no greater than 25% of 850° F.− material from the first stage. In some cases, some 850° F.+ material derived from the first stage may be employed in formulating the first stage liquefaction solvent.

As hereinabove indicated, at least 60% and preferably at least 75%, all by weight, of the first stage liquefaction solvent is comprised of materials produced in the second stage under controlled conditions, and the materials derived from the second stage include both materials which boil of from 500° F. to 850° F. (850° F.− material) and materials which boil above 850° F. (850° F.+ material). The weight ratio of 850° F.− material to 850° F.+ material (both derived from a controlled operation of the second stage), in the liquefaction solvent, is generally at least 0.8:1, and preferably at least 1:1. In most cases, the weight ratio does not exceed 6:1. In general, the 850° F.− material has solvent qualities which are better than the 850° F.+ material so, in general, liquefaction solvent quality is improved by increasing the amount of 850° F.− material from the second stage. However, as a practical matter, overall economics dictate the maximum ratio of 850° F.− material to 850° F.+ material produced in the second stage for use in formulating first stage liquefaction solvent.

The liquefaction solvent produced in accordance with the present invention has improved solvent qualities. The first stage liquefaction solvent employed in accordance with the invention generally has a hydrogen to carbon ratio of at least 0.95:1, and preferably at least 1.0:1. In most cases, the hydrogen to carbon ratio does not exceed 1.25:1. As a result of such improved qualities, the hydrogen partial pressure in the first stage liquefaction may be reduced, without reducing the overall conversion in the first stage liquefaction.

In accordance with a preferred embodiment, the first stage liquefaction is a short contact thermal liquefaction which is operated at an outlet temperature in the order of from 800° to 875° F., and particularly 820° F. to 865° F.; at a pressure in the order of from 500 to 2700 psig and in cases where higher amounts of hydrogen are required, the pressure may be from 1800 to 2700 psig; and at reaction contact times (at temperatures above 600° F.) in the order of from 2 to 15 minutes. It may be possible in some cases to further reduce the residence time. The coal liquefaction solvent employed in the first stage is provided in an amount such that the ratio of solvent to coal is in the order of from 1.2:1 to 3:1, on a weight basis. It is to be understood that greater amounts could be employed but, in general, such greater amounts are not economically justified. In additional, hydrogen, when used, may be added to the first stage in an amount of from 2000 to 15,000 SCF per tone of coal; however, higher or lower amounts may be employed. In some cases, it may be possible to operate the first stage without the addition of gaseous hydrogen. Coal conversion in the first stage, based on moisture ash free coal is generally 90% or greater.

The above conditions are illustrative, and the scope of the invention is not to be limited thereby.

In the two stage process of the present invention, insoluble material derived from the coal may be removed either after the first stage or subsequent to the second stage, and such procedure is generally referred to as "deashing", even though materials in addition to ash are removed.

In accordance with a preferred embodiment, the deashing is accomplished by the use of a liquid promoter having a characterization factor of at least 9.75, a 5 volume percent distillation temperature of at least about 250° F., and a 95 volume percent distillation temperature of at least about 350° F. and no greater than about 750° F., as described in U.S. Pat. No. 3,856,675. As described in such patent, a preferred promoter liquid is a kerosene fraction having 5% and 95% volume distillation temperatures of 450° F. and 500° F., respectively. It is to be understood, however that other methods may be employed within the spirit and scope of the invention.

In the second stage, material recovered from the first stage, which may or may not include insoluble material derived from the coal, is hydrogenated with gaseous hydrogen in two zones at controlled temperatures as hereinabove described. In general, both zones of the second stage are operated at pressures in the order of from 2000 to 3000 psig. In the second stage, such hydrogenation in effected in the presence of a hydrogenation catalyst of a type known in the art. For example, an oxide or sulfide of a group VI and group VIII metal, such as a cobalt-molybdenum or nickel-molybdenum catalyst, supported on a suitable support such as alumina or silica-alumina. Such hydrogenation converts a portion of the 850° F.+ material to hydrogenated distillates ($C_5$ to 850° F. material), and also produces hydrogen donors in the 850° F.+ residuum, as hereinabove described.

In accordance with a preferred embodiment, such second-stage liquefaction is accomplished in an upflow expanded bed, with such expanded beds being known in the art.

Thus, 500° F.+ (or 650° F.+) components recovered from the first zone of the second stage, which include components boiling within the range from 500° F. to 850° F., having a high hydrogen to carbon content, as well as hydrogenated components boiling above 850° F. (generally recovered from both the first and second zones of the second stage) are employed in formulating the liquefaction solvent, while permitting the production of net product (gas and $C_5$ to 850° F. components) in the second zone of the first stage at desired rates and quality, without affecting the quality of first stage liquefaction solvent formulated from materials produced in the first zone of the second stage.

Figure 2:
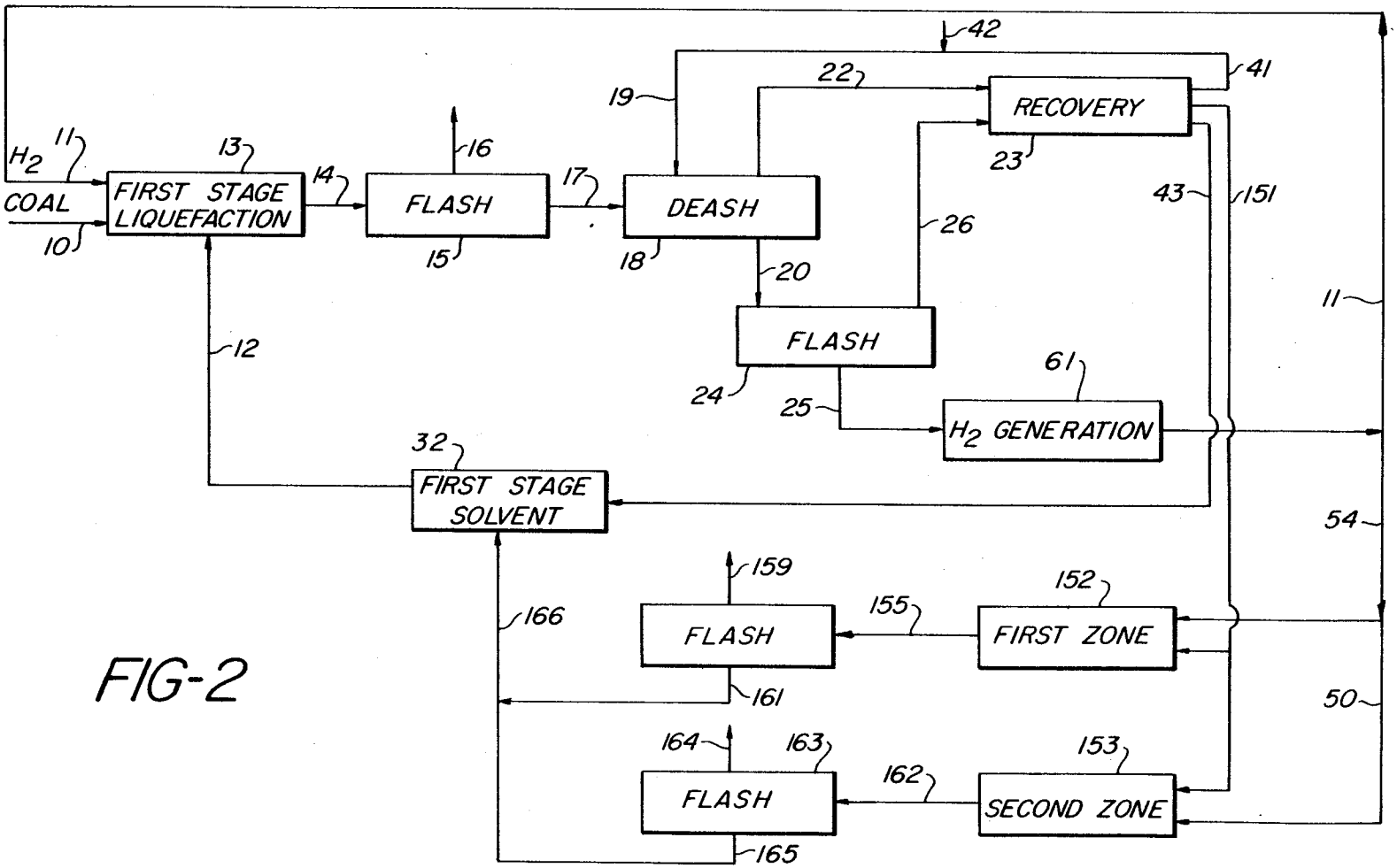

The invention will be further described with respect to embodiments thereof illustrated in the accompanying drawing, wherein:

FIGS. 1 and 2 of the drawings are simplified schematic block flow diagrams of embodiments of the invention.

It is to be understood, however, that the scope of the invention is not to be limited to the particularly described embodiment.

Referring now to the drawing, ground pulverized coal, generally bituminous, subbituminous or lignite, preferably bituminous coal, in line 10, hydrogen, if used, in line 11, and a coal liquefaction solvent, in line 12, obtained as hereinafter described, are introduced into the first stage liquefaction zone, schematically generally indicated as 13 for effecting a short contact thermal liquefaction of the coal. The thermal liquefaction is effected in the absence of catalyst. The first stage liquefaction is operated at the conditions hereinabove described.

A first stage coal liquefaction product is withdrawn from zone 13 through line 14, and introduced into a flash zone, schematically generally indicated as 15 in order to flash therefrom materials boiling below 500° F., and in some cases materials boiling below 650° F. Such flashed materials are removed from flash zone 15 through line 16 as product.

The remainder of the coal liquefaction product, in line 17, is introduced into a deashing zone, schematically generally indicated as 18 for separating ash and other insoluble material from the first stage coal liquefaction product. As particularly described, the deashing in zone 18 is accomplished by use of a promoter liquid for promoting and enhancing the separation of the insoluable material, with such promoter liquid being provided through line 19. In particular, the separation in deashing zone 18 is accomplished in one or more gravity settlers, with the promoter liquid and general procedure for accomplishing such deashing being described, for example, in U.S. Pat. No. 3,856,675. As hereinabove indicated, such promoter liquid is preferably a kerosene fraction having 5% and 95% volume distillation temperatures of 425° F. and 500° F., respectively.

The essentially ash free overflow is withdrawn from deashing zone 18 through line 22 for introduction into a recovery zone, schematically generally indicated as 23.

An underflow containing insoluble material is withdrawn from deashing zone 18 through line 20, and introduced into a flash zone, schematically generally indicated as 24 to flash material boiling below 850° F. therefrom. The flashing in zone 24 is accomplished in a manner such that there is recovered from flash zone 24, through line 25, a flowable stream containing insoluble material and 850° F.+ material. The flashed components are withdrawn from flash zone 24 through line 26 for introduction into recovery zone 23.

The 850° F.+ material in line 25 including insoluble components may be used as feedstock for generation of hydrogen, in zone 61; for example a partial oxidation process. Hydrogen is recovered from zone 61 and a portion thereof, as required, is employed in line 11.

The recovery zone 23 is operated so as to separate and recover promoter liquid for use in line 41; any 850° F.− material to be used in formulating liquefaction solvent, in line 43, and 850° F.+ material, as well as any 850° F.− material not used in producing liquefaction solvent, in line 51. Recovery zone 23 may include an atmospheric flash as well as a distillation column, with the atmospheric flash being operated to flash 850° F.− material free of 850° F.+ material from the deashed liquid, with the unflashed material being distilled to recover promoter liquid through line 41 (for example 425° F. to 500° F. material) with the remainder (500° F. or 650° F. to 850° F.) being recovered through line 43 for use in formulating the first stage liquefaction solvent in first stage liquefaction solvent zone 32. Make-up promoter liquid may be added through line 42.

The material recovered from the atmospheric flash in recovery zone 23 through line 51 includes the 850° F.+ material present in the ash free overflow recovered from deashing zone 18, as well as that portion of 850° F.− material not used in formulating liquefaction solvent (generally 500° F. or 650° F. to 850° F. material) so as to provide a pumpable feed for introduction into a second stage. As shown, the second liquefaction stage includes a first zone, schematically generally indicated as 52, which may contain one, two or more reactors, and a second zone 53, which may contain one, two or more reactors, with the first zone 52 being operated at temperatures lower than the second zone 53. As hereinabove described, the first zone 52 is operated at a temperature of at least 650° F. and no greater than 795° F., and the second zone is operated at a temperature of at least 800° F., and generally no greater than 840° F.

As shown, zones 52 and 53 are operated in series and the reactor or reactors in each zone include a suitable hydrogenation catalyst and are operated at conditions as hereinabove described. In a preferred embodiment, the reactor(s) are operated in the form of an upflow expanded bed.

As particularly shown, the effluent in line 51 is introduced into the first zone 52 of the second stage, along with hydrogen in line 54 obtained from hydrogen generation zone 61. As shown, the hydrogen requirements for both the first and second zones 52 and 53, respectively, are provided through line 54.

Effluent from the first zone 52, in line 55, is divided into two portions with the first portion being introduced into zone 53 through line 56 for further hydrogenation.

The second portion, in line 57, is introduced into a flash zone, generally indicated as 58, to recover, as flashed material in line 59, 500° F.− material (or 650° F.− material, depending on the conditions employed in the first liquefaction stage). The unflashed material in line 60 is used in formulating the first stage liquefaction solvent.

As a result of controlling the conditions in the first zone 52, as hereinabove described, the material in line 60 includes hydrogenated components boiling within the range of from 500° F. to 850° F., plus hydrogenated 850° F.+ components, which have a high hydrogen to carbon ratio. In addition, there is a sufficient quantity of material which boils within the range of 500° F. to 850° F. so as to improve the quality of the solvent; i.e., to provide ratios of 850° F.− material to 850° F.+ material, as hereinabove described. Moreover, this can be achieved without affecting the final product which is recovered from the second stage.

The portion of the effluent which is in line 56 is hydrogenated in the second zone 53, as hereinabove described, so as to produce a product having the desired hydrogen to carbon ratio and/or to achieve desired overall conversion and/or reaction rates, without affecting the ability to produce materials in the second stage desired for formulating first stage solvent.

The effluent from the second zone 53, in line 62, is introduced into a flash zone 63 to recover, as net product, in line 64, gas and $C_5$ to 850° F. components, which are essentially free of 850° F.+ material.

The unflashed portion in line 65 which contains 850° F.+ materials, and some unflashed 850° F.− material, is combined with the material recovered from the effluent from the first zone, which is in line 60 and the combined stream, in line 66, is employed in zone 32 for formulating liquefaction solvent for the first stage, as hereinabove described.

An alternative embodiment is shown in FIG. 2 wherein the two hydrogenation zones of the second stage are operated in parallel, instead of in series, as described with reference to the embodiment of FIG. 1.

In the embodiment of FIG. 2, the first and second zones of the second stage are employed in parallel with the relative amount of feed material introduced into the first and second zone being controlled so as to produce sufficient solvent for the first stage as well as net product.

As shown, the second liquefaction stage includes a first zone, schematically generally indicated as 152, which may contain one, two or more reactors, and a second zone 153, which may contain one, two or more reactors, with the first zone 152 being operated at temperatures lower than the second zone 153. As hereinabove described, the first zone 152 is operated at a temperature of at least 650° F. and no greater than 795° F., and the second zone is operated at a temperature of at least 800° F., and generally no greater than 840° F.

As shown, zones 152 and 153 are operated in parallel and the reactor or reactors in each zone include a suitable hydrogenation catalyst and are operated at conditions as hereinabove described. In a preferred embodiment, the reactor(s) are operated in the form of an upflow expanded bed.

As particularly shown, the effluent from the first stage, in line 151, is divided between the first zone 152 and the second zone 153, with hydrogen being introduced through lines 154 and 154*a*, respectively.

Effluent from the first zone 152, in line 155, is introduced into a flash zone, generally indicated as 158, to recover, as flashed material, in line 59, 500° F.− material (or 650° F.− material, depending on the conditions employed in the first liquefaction stage). The unflashed material in line 161, is used in formulating the first stage liquefaction solvent.

As a result of controlling the conditions in the first zone 152, as hereinabove described, the material in line 161 includes hydrogenated components boiling within the range of from 500° F. to 850° F., plus hydrogenated 850° F.+ components, which have a high hydrogen to carbon ratio. In addition, there is a sufficient quantity of material which boils within the range of 500° F. and 850° F. so as to improve the quality of the solvent; i.e., to provide ratios of 850° F.− material to 850° F.+ material produced in the second stage, as hereinabove described. Moreover, this can be achieved without affecting the final product which is recovered from the second stage.

In the second zone 153, as hereinabove described, the feed is hydrogenated, so as to produce a final product having the desired hydrogen to carbon ratio and/or to achieve desired overall conversion and/or reaction rates.

The effluent from the second zone 153, in line 162, is introduced into a flash zone 163 to recover, as net product, in line 164, gas and $C_5$ to 850° F. components which are essentially free of 850° F.+ material.

The unflashed portion, in line 165, which contains 850° F.+ materials, and some unflashed 850° F.− material is combined with the material recovered from the effluent from the first zone, which is in line 161 and the combined stream, in line 166, is employed in zone 32 for formulating liquefaction solvent, as hereinabove described.

Although the invention has been described with respect to preferred embodiments, such embodiments may be modified within the spirit and scope of the invention.

For example, deashing may be accomplished other than as described. Similarly, the second stage hydrogenation may be accomplished other than in an expanded bed.

Although it is preferred to employ some 850° F.− material from the first stage in formulating the liquefaction solvent in accordance with the embodiment of FIG. 1 or 2 in that such use reduces the amount of material which is processed in the second stage, it is to be understood that all of the 850° F.− material from the first stage may be introduced into the second stage.

As another modification, in some cases, little if any 500° F.− material will be generated in the first zone of the second stage, and in such cases, it is not necessary to flash 500° F.− material prior to use of material from the first zone for formulating liquefaction solvent.

The above modifications and others should be apparent to those skilled in the art from the teachings herein.

The invention will be further described with respect to the following example, however, the scope of the invention is not to be limited thereby:

EXAMPLE

The following is based on 36 lbs of coal feed to the first stage and 64 lbs of liquefaction solvent, all derived from the second stage, based on the embodiment of FIG. 1.

The feed to the first zone of the second stage is 83 lbs comprised of 41.5 lbs of 850° F.− and 41.5 lbs of 850° F.− material, all derived from the first stage.

The first stage solvent is comprised of 18.3 lbs of 850° F.− material and 16.7 lbs of 850° F.+ material from the first zone, and 23.2 lbs of 850° F.− material and 5.8 lbs of 850° F.+ material from the second zone 0.8 lb of hydrogen is introduced into each of the first and second zones.

20.6 lbs of gas and $C_5$ to 850° F. produt is recovered from the second stage. 4 lbs of 500° F.− product and 13 lbs of deasher bottoms (including ash and other insoluble material) is recovered from the first stage.

The following conditions are employed in the first and second zones of the second stage:

| | |
|---|---|
| First Zone | |
| Reactor Temperature | 700° F. |
| Liquid Hourly Space Velocity: | 3.0 vol./hr. vol reactor |
| Pressure: | 2700 psig |
| Conversion of 850° F.+: | 4% wt./wt. |
| Yield of −500° F. Product: | nil |
| Second Zone | |
| Reactor Temperature: | 830° F. |
| Liquid Hourly Space Velocity: | 0.5 |
| Pressure: | 2700 psig |
| Conversion of 850° F.+: | 75.0% wt./wt. |

The present invention is particularly advantageous in that by controlling second stage conditions and formulating the first stage solvent, as described, it is possible to operate the first stage at low consumption of gaseous hydrogen; i.e., no greater than 1.0 weight percent. Thus, if desired, the first stage can be operated at lower pressures. Moreover, it is possible to achieve such a result without a separate step for hydrogenating recycle components to be used in the first stage solvent.

In addition, it is possible to operate the first stage at short residence times; for example, two minutes or less (at temperatures above 600° F.) while maintaining high conversion; i.e., at least 90% in that hydrogen values are rapidly transferred from the solvent.

Furthermore, as a result of the presence of 850° F.+ material in the liquefaction solvent, coking is reduced in the first stage reactor.

In addition, the process is maintained in hydrogen balance by generating hydrogen from a mixture of insoluble material and 850° F.+ material derived from the coal feed.

All of the above advantages are achieved without limiting the conditions for producing final product in that conditions may be employed in the second zone which favor desired product properties.

These and other advantages should be apparent to those skilled in the art from the teachings herein.

Numerous modifications and variations of the present invention are possible in light of the above teachings and, therefore, within the scope of the appended claims the invention may be practiced otherwise than as particularly described.

What is claimed is:

1. A two-step process for the liquefaction of coal, comprising:

contacting coal with a liquefaction solvent in a first stage to produce a liquefaction effluent containing 850° F.− material and 850° F.+ material; recovering from the liquefaction effluent feed material comprising at least a portion of the 850° F.− material and 850° F.+ material; hydrogenating feed material in a second stage in first and second hydrogenating zones of said second stage, said first zone being operated at a temperature of from 650° F. to 795° F., the second zone being operated at a temperature of at least 800° F. and no greater than 840° F.; recovering from both the first and second zones a portion of 850° F.− material as product; recovering from both the first and second zones a mixture of 850° F.− material and 850° F.+ material, said mixture having a weight ratio of 850° F.− material to 850° F.+ material of from 0.8:1 to 6:1; and directly employing said mixture, without additional hydrogenation, as at least a portion of the liquefaction solvent used in the first stage, said liquefaction solvent being comprised of from 0% to 40% of 850° F.− material from the first stage effluent, and from 60% to 100% of said mixture, all by weight.

2. The process of claim 1 wherein said ratio of 850° F.− material to 850° F.+ material recovered in the mixture is at least 1:1.

3. The process of claim 1 wherein the first and second zones are in series with a portion of effluent from the first zone being employed as feed to the second zone.

4. The process of claim 1 wherein the first and second zones are in parallel, a portion of the feed material from the first stage being introduced into the first zone and a further portion of the feed material from the first stage being introduced into the second zone.

5. The process of claim 1 wherein the 850° F.− material from the first stage is present in the liquefaction solvent in an amount from 5% to 25%.

6. The process of claim 1 wherein the first stage is a short contact time thermal liquefaction.

7. The process of claim 1 wherein the liquefaction solvent has a hydrogen to carbon ratio of at least 0.95:1.

8. The process of claim 1 wherein the first stage is a short contact thermal liquefaction operated at an outlet temperature of from 800° F. to 875° F.

9. The process of claim 8 wherein gaseous hydrogen is employed in the first stage and gaseous hydrogen consumption in the first stage is less than 1%.

10. The process of claim 9 wherein residence time for the first stage at temperatures above 600° F. is 2 to 15 minutes.

11. The process of claim 10 wherein conversion of moisture ash free coal in the first stage is at least 90%.

12. The process of claim 11 wherein a mixture of insoluble material and 850° F.+ material derived from the coal is recovered from one of the two stages and further comprising producing hydrogen from the mixture for use in the liquefaction process.

13. The process of claim 1 wherein the coal is bituminous coal.

14. A two-stage process for liquefying bituminous coal, comprising:

contacting coal with liquefaction solvent in a first stage to produce a liquefaction effluent, said first stage being a short residence time thermal liquefaction stage; recovering a liquefaction effluent from the first stage containing 850° F.− material and 850° F.+ material; separating insoluble material from the liquefaction effluent; recovering from the liquefaction effluent a feed material comprising at least a portion of the 850° F.− material and 850° F.+ material; hydrogenating feed material in a second stage in first and second hydrogenating zones, said first zone being operated at a temperature of from 650° F. to 795° F. and the second zone being operated at a temperature of at least 800° F. and no greater than 840° F.; recovering from both the first and second zones a portion of 850°− material as product; recovering from both the first and second zones a mixture of 850° F.− material and 850° F.+ material, said mixture having a weight ratio of 850° F.− material to 850° F.− material of from 0.8:1 to 6:1; and directly employing said mixture, without additional hydrogenation, as at least a portion of liquefaction solvent used in the first stage, said liquefaction solvent being comprised of from 0% to 40% of 850° F.− material from the first stage effluent and from 60% to 100% of said mixture, all by weight.

15. The process of claim 14 wherein the first and second zones are in series, and a portion of first zone effluent is introduced as feed to the second zone.

16. The process of claim 15 wherein the 850° F.− material from the first stage is present in the liquefaction solvent in an amount of from 5% to 25%.

17. The process of claim 16 wherein the first stage is a short contact thermal liquefaction operated at an outlet temperature of from 800° F. to 875° F.

18. The process of claim 17 wherein residence time for the first stage at temperatures above 600° F. is 2 to 15 minutes.

19. The process of claim 18 wherein 850° F.− material from the first stage is present in the liquefaction solvent in an amount of from 10% to 25%.

20. The process of claim 19 wherein conversion of moisture ash free coal in the first stage is at least 90%.

21. The process of claim 20 wherein gaseous hydrogen is employed in the first stage and gaseous hydrogen consumption in the first stage is less than 1%.

* * * * *